US006994636B2

(12) United States Patent
Hocknell et al.

(10) Patent No.: US 6,994,636 B2
(45) Date of Patent: Feb. 7, 2006

(54) GOLF CLUB HEAD

(75) Inventors: Alan Hocknell, Encinitas, CA (US); J. Andrew Galloway, Escondido, CA (US)

(73) Assignee: Callaway Golf Company, Carlsbad, CA (US)

( * ) Notice: Subject to any disclaimer, the term of this patent is extended or adjusted under 35 U.S.C. 154(b) by 170 days.

(21) Appl. No.: 10/249,312

(22) Filed: Mar. 31, 2003

(65) Prior Publication Data

US 2004/0192467 A1 Sep. 30, 2004

(51) Int. Cl.
*A63B 53/04* (2006.01)

(52) U.S. Cl. ..... 473/342; 473/345; 473/349

(58) Field of Classification Search ..... 473/324–350, 473/290–291

See application file for complete search history.

(56) References Cited

U.S. PATENT DOCUMENTS 1,167,387 A * 1/1916 Daniel ..... 473/337
1,638,916 A * 8/1927 Butchart ..... 473/312
1,780,625 A * 11/1930 Mattern ..... 473/324
2,750,194 A * 6/1956 Clark ..... 473/337
3,692,306 A * 9/1972 Glover ..... 473/306
3,897,066 A * 7/1975 Belmont ..... 473/337
3,937,474 A * 2/1976 Jepson et al. ..... 473/342
3,970,236 A * 7/1976 Rogers ..... 228/196
3,975,023 A * 8/1976 Inamori ..... 473/329
3,989,248 A * 11/1976 Campau ..... 473/329
4,021,047 A * 5/1977 Mader ..... 473/345
4,398,965 A * 8/1983 Campau ..... 148/522
4,432,549 A * 2/1984 Zebelean ..... 473/346
4,438,931 A * 3/1984 Motomiya ..... 473/346
4,568,088 A * 2/1986 Kurahashi ..... 473/343
4,872,685 A * 10/1989 Sun ..... 473/349
4,877,249 A * 10/1989 Thompson ..... 473/349
4,930,781 A * 6/1990 Allen ..... 473/346
5,024,437 A * 6/1991 Anderson ..... 473/342
5,028,049 A * 7/1991 McKeighen ..... 473/345
5,094,383 A * 3/1992 Anderson et al. ..... 228/176
5,106,094 A * 4/1992 Desbiolles et al. ..... 473/342
5,163,682 A * 11/1992 Schmidt et al. ..... 473/332
5,193,811 A * 3/1993 Okumoto et al. ..... 473/349
5,255,918 A * 10/1993 Anderson et al. ..... 473/330
5,261,663 A * 11/1993 Anderson ..... 473/342
5,261,664 A * 11/1993 Anderson ..... 473/342
5,282,624 A * 2/1994 Viste ..... 473/342
5,310,185 A * 5/1994 Viollaz et al. ..... 473/330
5,318,300 A * 6/1994 Schmidt et al. ..... 473/305
5,344,140 A * 9/1994 Anderson ..... 473/342
5,346,216 A * 9/1994 Aizawa ..... 473/329
5,346,217 A * 9/1994 Tsuchiya et al. ..... 473/345
5,377,986 A * 1/1995 Viollaz et al. ..... 473/330
5,398,935 A * 3/1995 Katayama ..... 473/349
5,410,798 A * 5/1995 Lo ..... 29/527.2
5,425,538 A * 6/1995 Vincent et al. ..... 473/342
5,464,210 A * 11/1995 Davis et al. ..... 473/537
5,474,296 A * 12/1995 Schmidt et al. ..... 473/346

(Continued)

*Primary Examiner*—Sebastiano Passaniti
(74) *Attorney, Agent, or Firm*—Michael A. Catania; Elaine H. Lo

(57) ABSTRACT

A golf club head (20) having a body (22) with a front wall (30) with an opening (32) and a face component (40) is disclosed herein. The face component (40) preferably has a striking plate (50), a crown extension (52) and a sole extension (54). The golf club head (20) has a volume between 200 cubic centimeters and 600 cubic centimeters. The golf club head (20) has a mass between 140 grams and 215 grams.

24 Claims, 7 Drawing Sheets

U.S. PATENT DOCUMENTS 5,499,814 A * 3/1996 Lu ..... 473/329
5,516,107 A * 5/1996 Okumoto et al. ..... 473/346
5,518,240 A * 5/1996 Igarashi ..... 473/345
5,547,427 A * 8/1996 Rigal et al. ..... 473/345
5,570,886 A * 11/1996 Rigal et al. ..... 473/345
5,624,331 A * 4/1997 Lo et al. ..... 473/345
5,743,813 A * 4/1998 Chen et al. ..... 473/329
5,755,627 A * 5/1998 Yamazaki et al. ..... 473/345
5,776,011 A * 7/1998 Su et al. ..... 473/345
5,830,084 A * 11/1998 Kosmatka ..... 473/349
5,863,261 A * 1/1999 Eggiman ..... 473/329
5,888,148 A * 3/1999 Allen ..... 473/290
5,967,904 A * 10/1999 Nagai et al. ..... 473/345
6,010,411 A * 1/2000 Reyes ..... 473/345
6,048,278 A * 4/2000 Meyer et al. ..... 473/345
6,146,571 A * 11/2000 Vincent et al. ..... 264/221
6,149,534 A * 11/2000 Peters et al. ..... 473/345
6,152,833 A * 11/2000 Werner et al. ..... 473/324
6,165,081 A * 12/2000 Chou ..... 473/329
6,334,817 B1 * 1/2002 Ezawa et al. ..... 473/324
6,338,683 B1 * 1/2002 Kosmatka ..... 473/329
6,348,013 B1 * 2/2002 Kosmatka ..... 473/329
6,348,015 B1 * 2/2002 Kosmatka ..... 473/342
6,354,962 B1 * 3/2002 Galloway et al. ..... 473/342
6,368,234 B1 * 4/2002 Galloway ..... 473/349
6,381,828 B1 * 5/2002 Boyce et al. ..... 29/527.4
6,386,990 B1 * 5/2002 Reyes et al. ..... 473/344
6,390,933 B1 * 5/2002 Galloway et al. ..... 473/345
6,398,666 B1 * 6/2002 Evans et al. ..... 473/345
6,406,381 B2 * 6/2002 Murphy et al. ..... 473/345
6,425,832 B2 * 7/2002 Cackett et al. ..... 473/345
6,440,011 B1 * 8/2002 Hocknell et al. ..... 473/342
6,471,604 B2 * 10/2002 Hocknell et al. ..... 473/334
6,491,592 B2 * 12/2002 Cackett et al. ..... 473/342
6,565,452 B2 * 5/2003 Helmstetter et al. ..... 473/342
6,582,323 B2 * 6/2003 Soracco et al. ..... 473/342
6,602,149 B1 * 8/2003 Jacobson ..... 473/329
6,607,452 B2 * 8/2003 Helmstetter et al. ..... 473/245
6,623,376 B2 * 9/2003 Poynor ..... 473/342
6,648,774 B1 * 11/2003 Lee ..... 473/342
6,663,501 B2 * 12/2003 Chen ..... 473/324
6,669,576 B1 * 12/2003 Rice ..... 473/305
6,669,577 B1 * 12/2003 Hocknell et al. ..... 473/329
6,758,763 B2 * 7/2004 Murphy et al. ..... 473/342
6,780,124 B2 * 8/2004 Lu ..... 473/342
2003/0181257 A1 * 9/2003 Yamamoto ..... 473/342

* cited by examiner

GOLF CLUB HEAD

CROSS REFERENCE TO RELATED APPLICATIONS

Not Applicable

FEDERAL RESEARCH STATEMENT

Not Applicable

BACKGROUND OF INVENTION

1. Field of the Invention

The present invention relates to a golf club head. More specifically, the present invention relates to a golf club head with a face component.

2. Description of the Related Art

High performance drivers employ relatively thin, high strength face materials. These faces are either formed into the curved face shape then welded into a driver body component around the face perimeter, or forged into a cup shape and connected to a body by either welding or adhesive bonding at a distance offset from the face of up to 0.75 inch or more. In a popular embodiment of the sheet-formed face insert driver, the weld between the formed face insert and the investment cast driver body is located on the striking face, a small distance from the face perimeter. It is common practice for the face insert to be of uniform thickness and to design the surrounding driver body component to be of equal thickness. In this way there is continuity of face thickness across the weld.

Several patents disclose face inserts. Anderson, U.S. Pat. Nos. 5,024,437, 5,094,383, 5,255,918, 5,261,663 and 5,261,664, disclose a golf club head having a full body composed of a cast metal material and a face insert composed of a hot forged metal material.

Viste, U.S. Pat. No. 5,282,624 discloses a golf club head with a cast metal body and a forged steel face insert with grooves on the exterior surface and the interior surface of the face insert and having a thickness of 3 mm.

Rogers, U.S. Pat. No. 3,970,236, discloses an iron club head with a formed metal face plate insert fusion bonded to a cast iron body.

Galloway, et al., U.S. Pat. No. 6,354,962 discloses a golf club head of a face cup design.

However, there is a need for a golf club head with a face component that performs better than conventional face insert club heads and provides cost savings.

SUMMARY OF INVENTION

The present invention overcomes the problems of the prior art by providing a golf club head that has a body with a face component. This allows the golf club head of the present invention to have better performance than a conventional face insert golf club head and to have a lower cost than a full face cup golf club head.

One aspect of the present invention is a golf club head with a body and a face component. The body has a crown, a sole, a ribbon, a heel front wall and a toe front wall. The crown has a thickness of 0.030 inch to 0.050 inch. The sole has a thickness of 0.030 inch to 0.050 inch. The body is preferably composed of a cast titanium alloy material. The body has an opening in a portion of the front wall, a portion of the crown and a portion of the sole. The body also has a hollow interior. The U-shaped face component is positioned within the opening of the body. The U-shaped face component has a striking plate, a crown extension substantially perpendicular to the striking plate, and a sole extension substantially perpendicular to the striking plate. The striking plate is welded to the heel front wall and the toe front wall. The crown extension is welded to the crown of the body. The sole extension is welded to the sole of the body. The face component has a uniform thickness in the range of 0.080 inch to 0.120 inch. The face component is preferably composed of a formed titanium alloy material.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
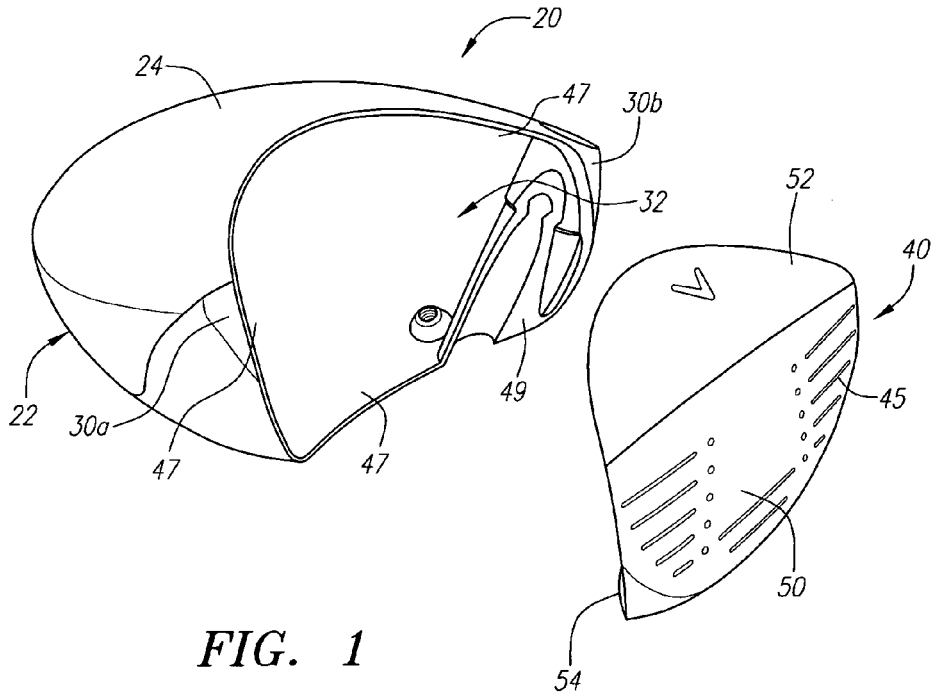
FIG. 1 is an exploded view of the components of a preferred embodiment of the golf club head of the present invention.

As shown in FIGS. 1–8, the golf club head of the present invention is generally designated 20. The golf club head 20 of FIGS. 1–8 is a driver, however, the golf club head of the present invention may alternatively be a fairway wood. The golf club head 20 has a body 22 that is preferably composed of a metal material such as titanium, titanium alloy, or the like, and is most preferably composed of a cast titanium alloy material. The body 22 is preferably cast from molten metal in a method such as the well-known lost-wax casting method. The metal for casting is preferably titanium or a titanium alloy such as 6-4 titanium alloy, alpha-beta titanium alloy or beta titanium alloy for forging, and 6-4 titanium for casting. Alternatively, the body 22 is composed of 17-4 steel alloy. Additional methods for manufacturing the body 22 include forming the body 22 from a flat sheet of metal, super-plastic forming the body 22 from a flat sheet of metal, electrochemical milling the body from a forged pre-form, casting the body using centrifugal casting, casting the body using levitation casting, and like manufacturing methods.

The golf club head 20, when designed as a driver, preferably has a volume from 200 cubic centimeters to 600 cubic centimeters, more preferably from 300 cubic centimeters to 450 cubic centimeters, and most preferably from 350 cubic centimeters to 420 cubic centimeters. A golf club head 20 for a driver with a body 22 composed of a cast titanium alloy most preferably has a volume of 380 cubic centimeters. The volume of the golf club head 20 will also vary between fairway woods (preferably ranging from 3-woods to eleven woods) with smaller volumes than drivers.

The golf club head 20, when designed as a driver, preferably has a mass no more than 215 grams, and most preferably a mass of 180 to 215 grams. When the golf club head 20 is designed as a fairway wood, the golf club head preferably has a mass of 135 grams to 180 grams, and preferably from 140 grams to 165 grams.

The body 22 has a crown 24, a sole 26, a ribbon 28, and a front wall 30 preferably composed of a heel front wall 30*b* and a toe front wall 30*a*. The body also has an opening 32 in the front wall 30 and extending into the crown 24 and the sole 26. The body 22 preferably has a hollow interior 47. The golf club head 20 has a heel end 36, a toe end 38 an aft end 37. A shaft, not shown, is placed within a hosel 49 at the heel end 36. In a preferred embodiment, the hosel 49 is internal to the body 22, and the shaft extends to the sole 26.

Figure 10:
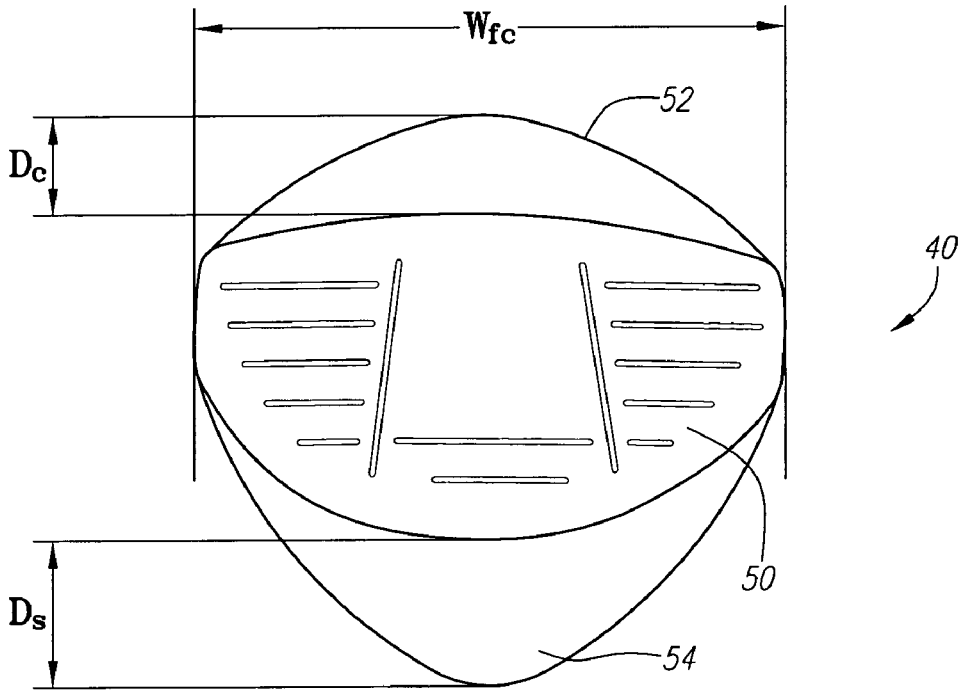
FIG. 10 is an isolated view of a face component.

The golf club head 20 has face component 40 that is attached to the body 22 over the opening 32. The face component 40 is preferably composed of a striking plate 50, a crown extension 52 and a sole extension 54. The striking plate 50, the crown extension 52 and the sole extension 54 preferably form a U-shaped face component 40. As shown in FIG. 10, the striking plate 50 has a width Wfc that preferably ranges from 2.0 inches to 4.0 inches. As shown in FIG. 10, the crown extension 52 extends from the edge of the striking plate 50 a distance "Dc" that preferably ranges from 0.250 inch to 2.5 inches. As shown in FIG. 10, the sole extension 54 extends from the edge of the striking plate 50 a distance "Ds" that preferably ranges from 0.250 inch to 2.5 inches.

The face component 40 preferably is composed of a formed titanium alloy material. Such titanium materials include titanium alloys such as 6-22-22 titanium alloy, Ti 10-2-3 alloy and Beta-C titanium alloy, all available from RTI International Metals of Ohio, SP-700 titanium alloy available from Nippon Steel of Tokyo, Japan, DAT 55G titanium alloy available from Diado Steel of Tokyo, Japan, and like materials. The preferred material for the face component 40 is a heat treated 6-22-22 titanium alloy, which is a titanium alloy composed by weight of titanium, 6% aluminum, 2% tin, 2% chromium, 2% molybdenum, 2% zirconium and 0.23% silicon.

In the preferred embodiment, the face component 40 is cut from a flat sheet of material. The face component 40 is cut using a water jet or electro-discharge machining method, and then hot-formed to the required shape. Use of a formed sheet material allows for a club head with a deeper face than typical forged materials. Further methods such as chemical milling or precision grinding may be used to reduce the thickness or portions of the face component 40. One such chemical milling method is disclosed in U.S. Pat. No. 6,381,828, entitled Chemical Etching Of A Striking Plate For A Golf Club Head.

The face component 40 is preferably welded to the body 22, thereby covering the opening 32. The striking plate 50 is preferably welded to the toe front wall 30*a* and the heel front wall 30*b*. The crown extension 52 is preferably welded to the crown 24. The sole extension 54 is preferably welded to the sole 26. Alternatively, the face component 40 may be press-fitted into the opening 32.

In a preferred embodiment, the striking plate 50 has uniform thickness that ranges from 0.040 inch to 0.250 inch, more preferably a thickness of 0.080 inch to 0.120 inch, and is most preferably 0.108 inch for a titanium alloy face component 40.

Figure 11:
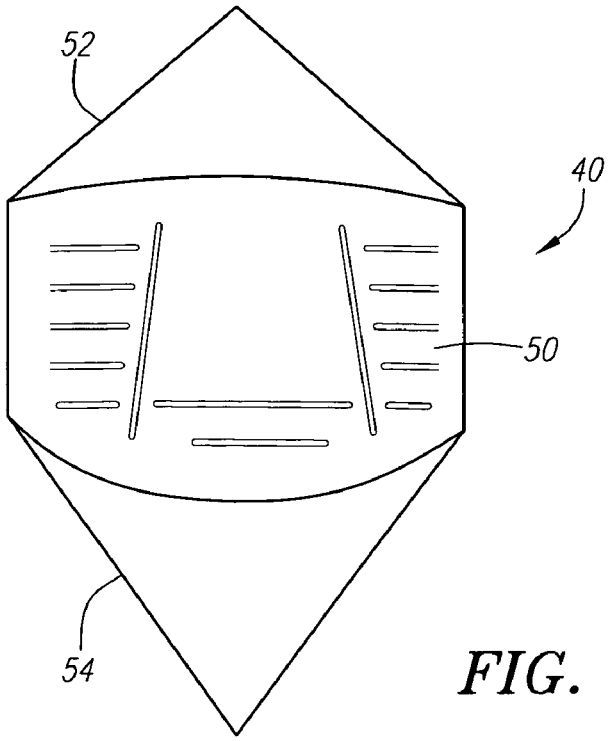
FIG. 11 is an isolated view of an alternative face component.
Figure 12:
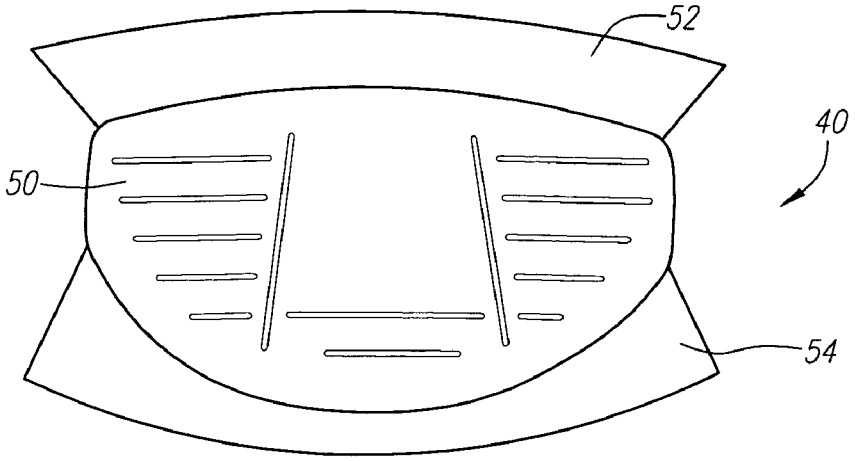
FIG. 12 is an isolate view of yet another alternative face component.

As shown in FIG. 10, the preferred embodiment of the face component 40 has a crown extension 52 and a sole extension 54 that have an arc shape. As shown in FIG. 11, in an alternative embodiment, the crown extension 52 and the sole extension 54 have a triangular shape. As shown in FIG. 12, in yet another alternative embodiment, the crown extension 52 and the sole extension 54 have pseudo-trapezoidal shapes. In these alternative embodiments, the opening 32 of the body 22 would be shaped to fit the face component 40.

The present invention is directed at a golf club head that has a high coefficient of restitution thereby enabling greater distance of a golf ball hit with the golf club head of the present invention. The coefficient of restitution (also referred to herein as COR) is determined by the following equation:

$$e = \frac{y_2 - y_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head 20 preferably having a coefficient of restitution preferably ranging from 0.80 to 0.87, and more preferably from 0.82 to 0.86, as measured under standard USGA test conditions.

Figure 2:
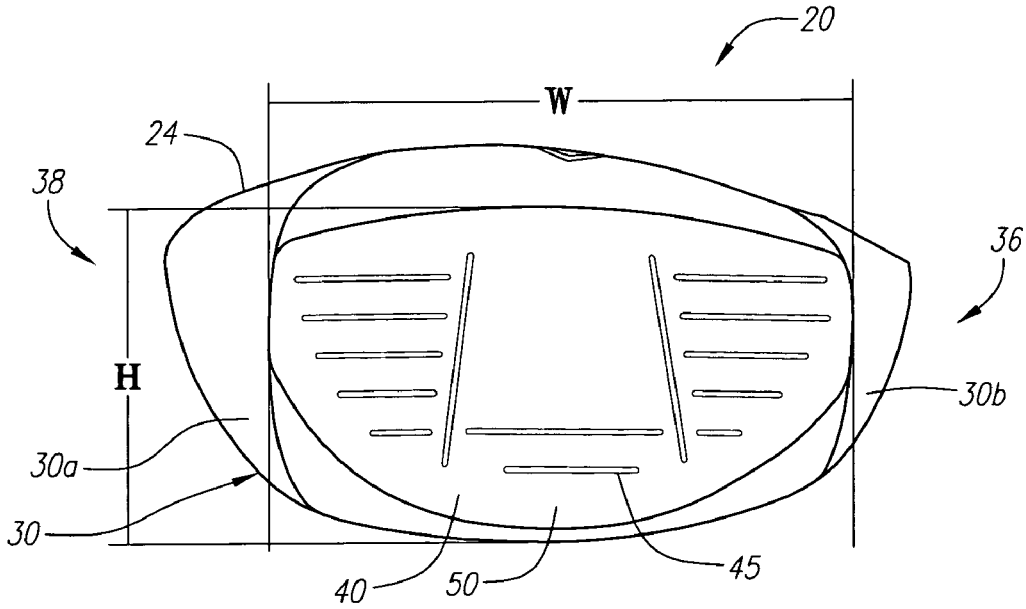
FIG. 2 is a front view of a golf club head of the present invention.
Figure 3:
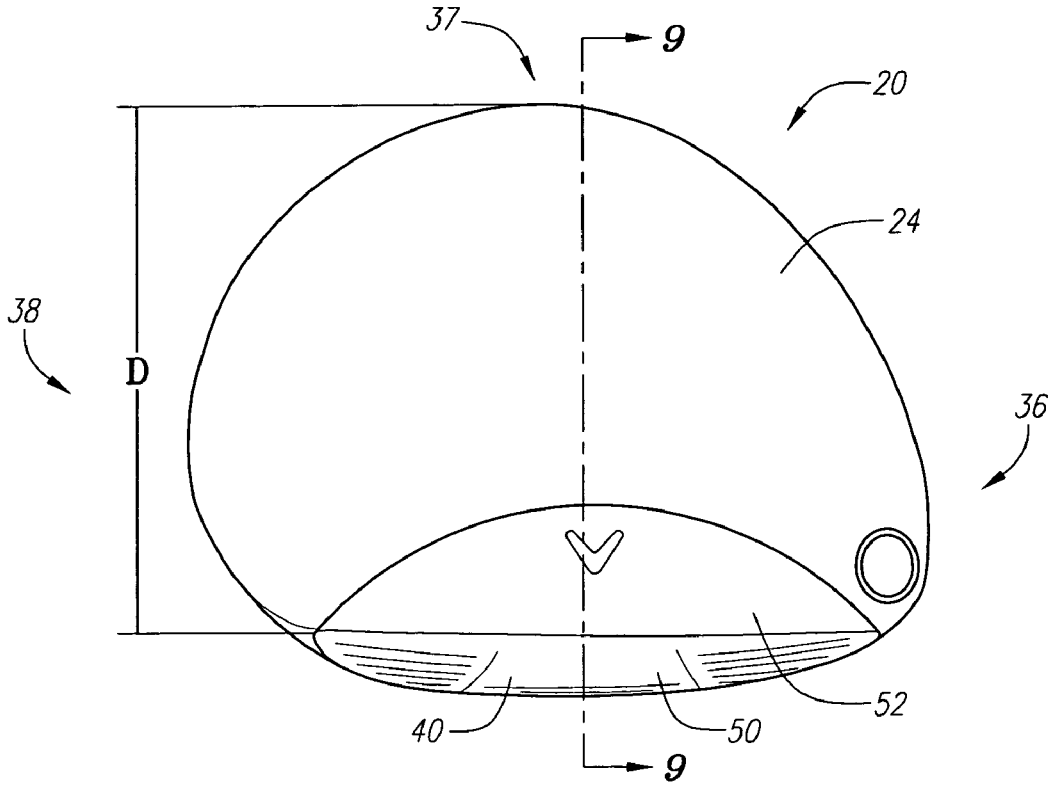
FIG. 3 is a top plan view of a golf club head of the present invention.
Figure 4:
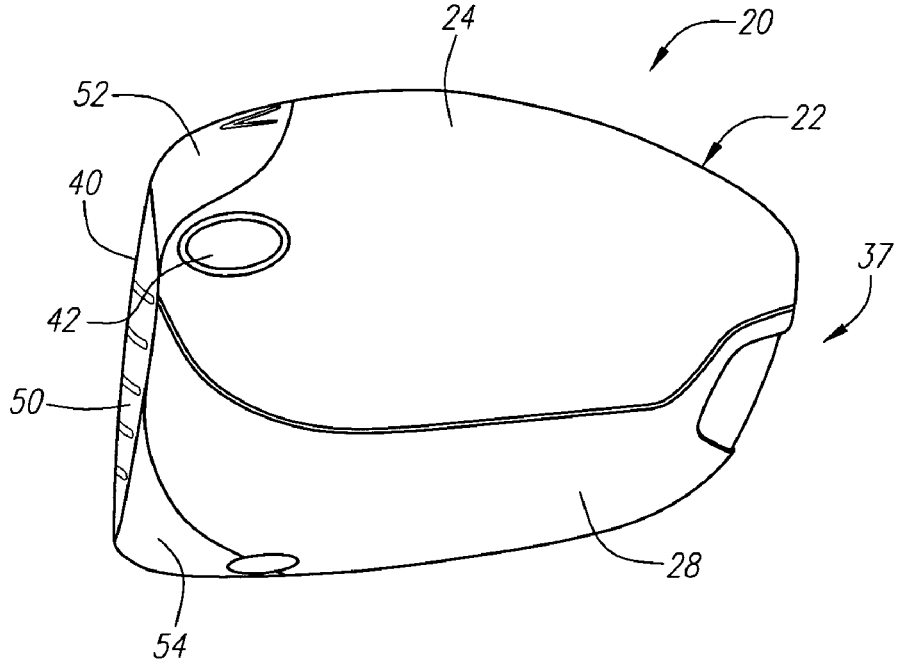
FIG. 4 is a side view of the heel end of a golf club head of the present invention.
Figure 5:
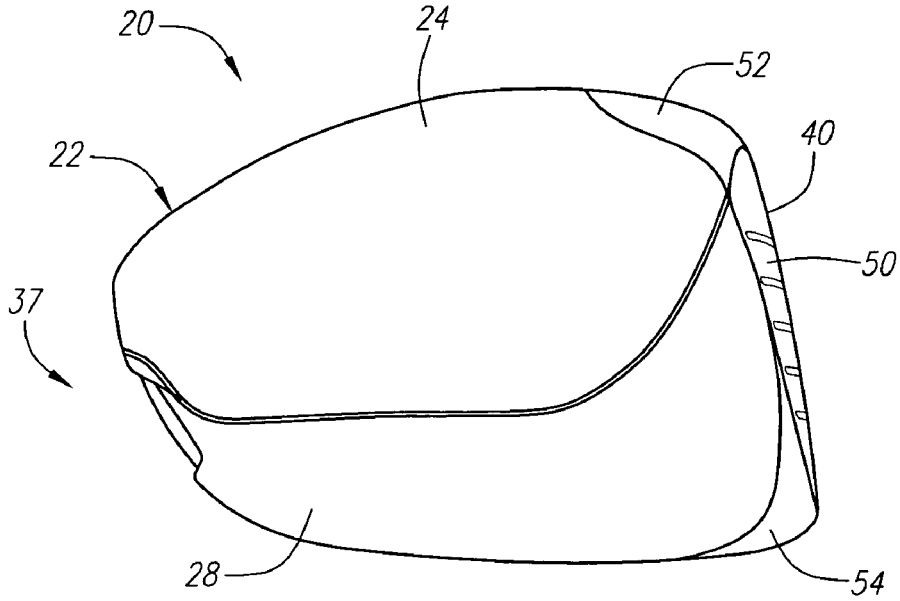
FIG. 5 is side view of the toe end of a golf club head of the present invention.
Figure 6:
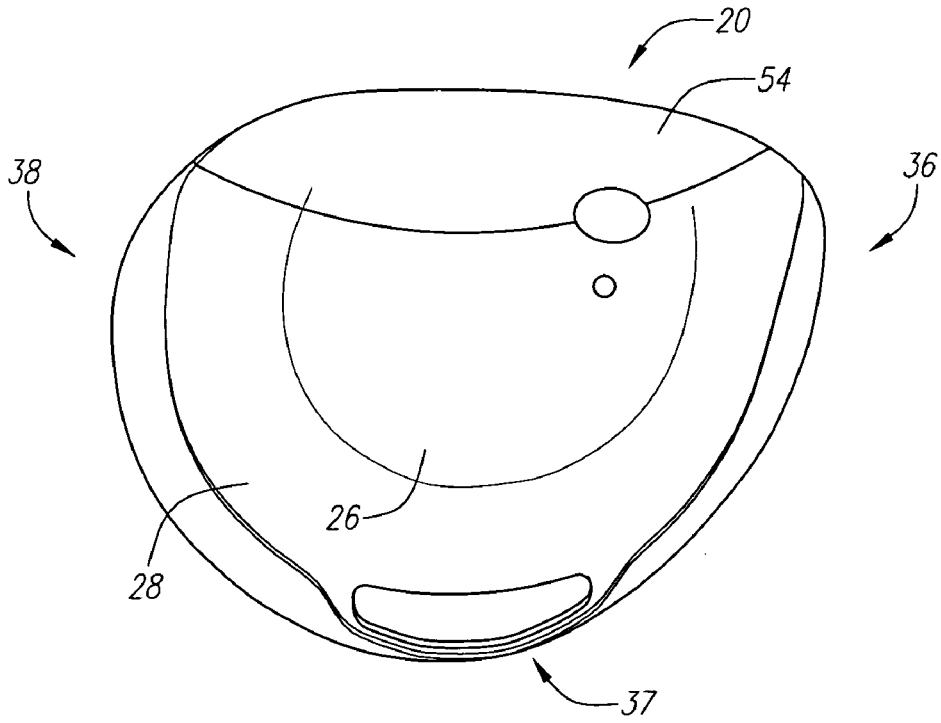
FIG. 6 is a bottom plan view of a golf club head of the present invention.
Figure 7:
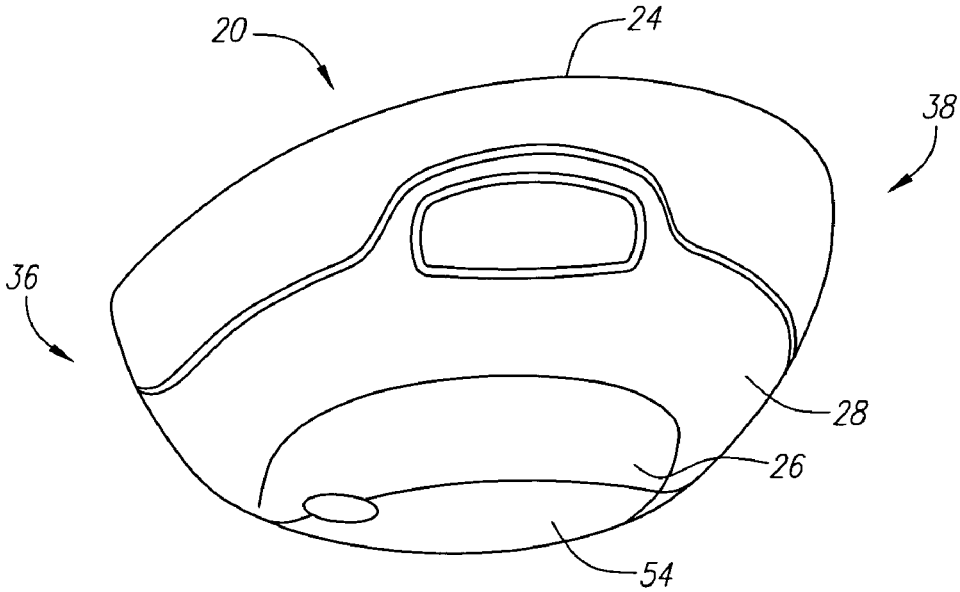
FIG. 7 is a rear view of a golf club head of the present invention.
Figure 8:
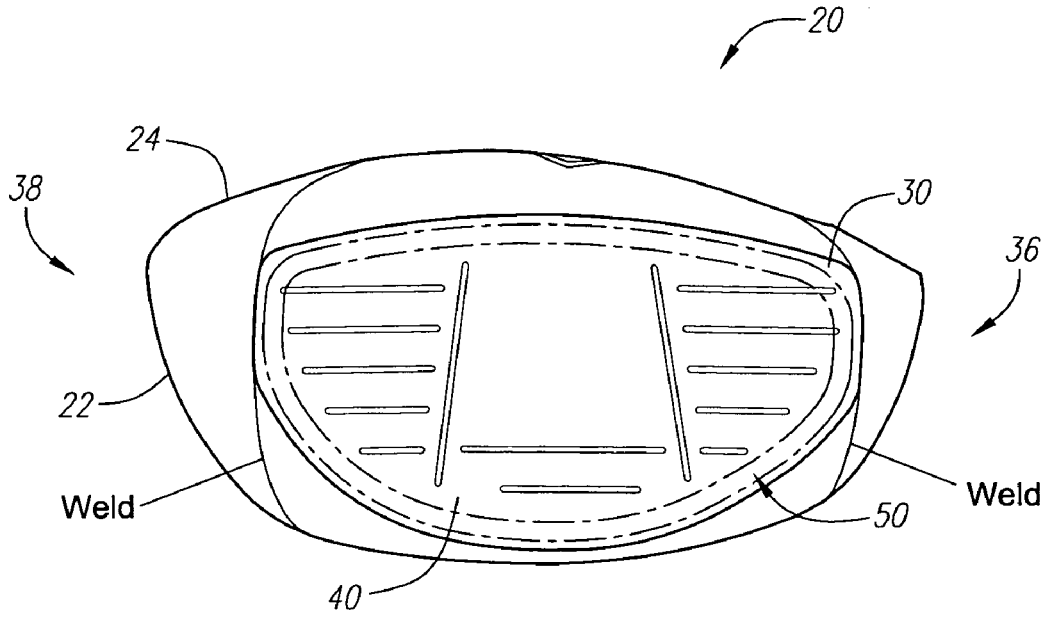
FIG. 8 a front view of a golf club head of the present invention showing the perimeter region in dashed lines.
Figure 9:
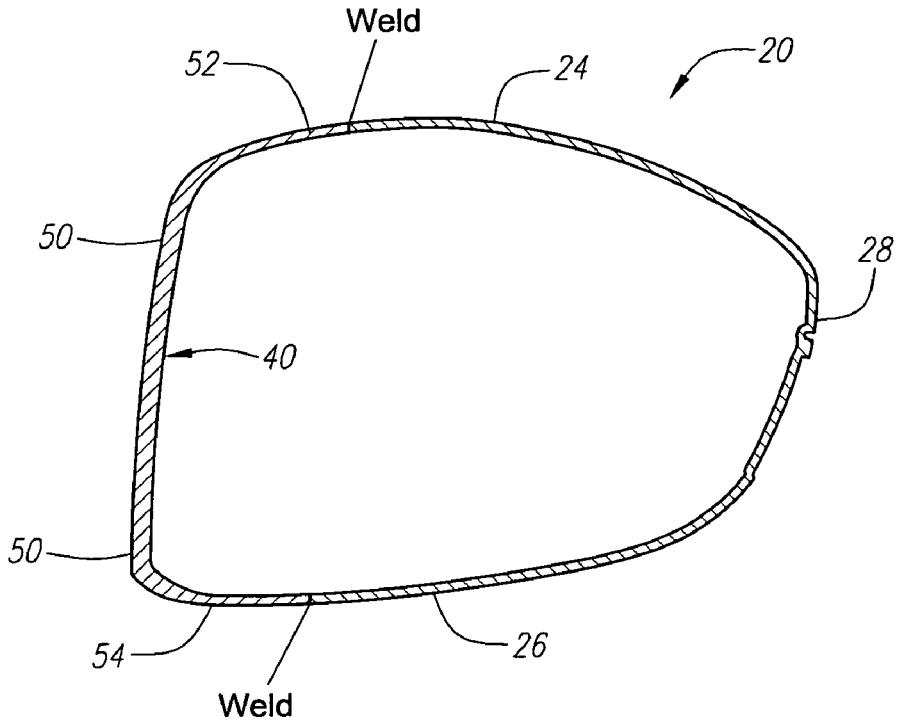
FIG. 9 is a cross-sectional view along line 9—9 of FIG. 3.

The depth of the club head 20 from the striking plate insert 50 to the aft-end 37 preferably ranges from 3.0 inches to 4.5 inches, and is most preferably 3.75 inches. As shown in FIG. 2, The height, "H", of the club head 20, as measured while in address position, preferably ranges from 2.0 inches to 3.5 inches, and is most preferably 2.50 inches or 2.9 inches. The width, "W", of the club head 20 from the toe end 38 to the heel end 36 preferably ranges from 4.0 inches to 5.0 inches, and more preferably 4.7 inches.

The face 45 of the golf club head 20 preferably has a large aspect ratio. The aspect ratio as used herein is defined as the height, "H", of the face 45 divided by the width, W, of the face 45. The width, "W", is measured between the farthest limits of the face 45 from the heel end 36 to the toe end 38. The measured width, W, does not include any portion of the body 22 that may be on the front of the club head 20 but not part of the face 45. The face 45 does include the striking plate 50 of the face component, the toe front wall 30*a* and the heel front wall 30*a*. The height, H, is measured from between the farthest limits of the face 45 from the crown 24 to the sole 26. As with the width, W, the height, H, does not include any portion of the body 22 that may be on the front of the club head 20 but not part of the face 45.

In one embodiment, the width W is 3.35 inches and the height H is 2.0 inches giving an aspect ratio of 0.6. The face 45 of the golf club head 20 preferably has an aspect ratio that is greater than 0.575. The aspect ratio of the face 45 preferably ranges from 0.575 to 0.8, and is most preferably from 0.6 to 0.7. A discussion of the aspect ratio of the face of a golf club head is disclosed in Kosmatka, U.S. Pat. No. 6,338,683 for Striking Plate For A Golf Club Head, which is hereby incorporated by reference in its entirety.

The center of gravity and the moments of inertia of the golf club head 20 may be calculated as disclosed in co-pending U.S. patent application Ser. No. 09/796,951, filed on Feb. 27, 2001, entitled High Moment Of Inertia Composite Golf Club, and hereby incorporated by reference in its entirety. In general, the moment of inertia, Izz, about the Z axis for the golf club head 20 will preferably range from 2700 g-cm$^2$ to 4000 g-cm$^2$, more preferably from 3000 g-cm$^2$ to 3800 g-cm$^2$. The moment of inertia, Iyy, about the Y axis for the golf club head 20 will preferably range from 1500 g-cm$^2$ to 3500 g-cm$^2$.

Further, the golf club head 20 preferably has superior products of inertia wherein at least one of the products inertia, Ixy, Ixz and Iyz, of the golf club head 20 has an absolute value less than 100 g-cm$^2$, and more preferably two or three products of inertia, Ixy, Ixz and Iyz, of the golf club head 20 have an absolute value less than 100 g-cm$^2$. A discussion of the products of inertia is disclosed in Cackett, et al., U.S. Pat. No. 6,425,832 for Large Volume Driver Head With High Moments Of Inertia, which is hereby incorporated by reference in its entirety.

Figure 13:
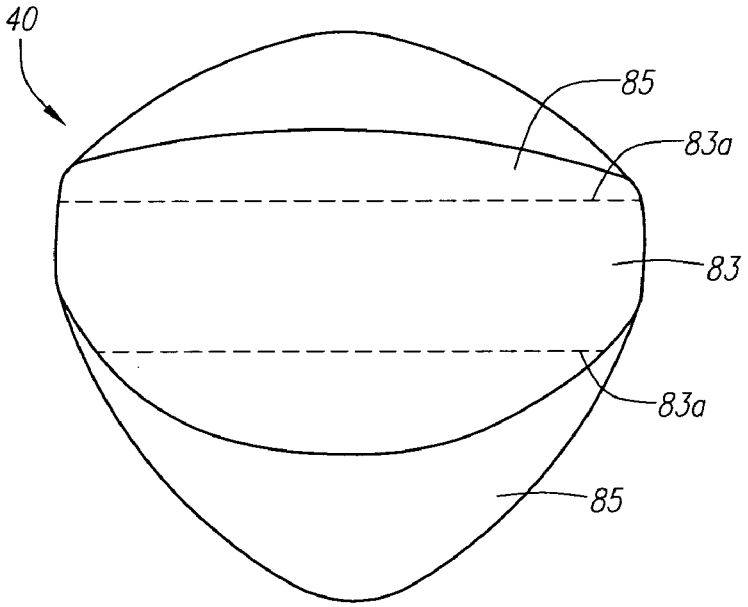
FIG. 13 is an isolated view of the face component illustrating an alternative embodiment with variable thickness.
Figure 13A:
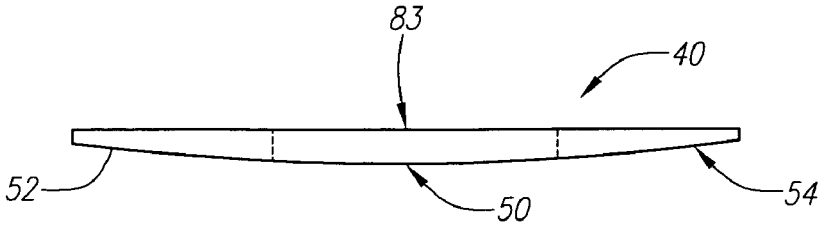
FIG. 13A is a cross-sectional view of the face component of FIG. 13.

In an alternative embodiment, the face component 40 has a variable thickness wherein a central region is thicker than periphery regions. As illustrated in FIG. 13, the central region 83 is thicker than periphery regions 85. In a preferred embodiment, the central region 83 extends across the striking plate 50 from heel to toe, and the thickness of the periphery region tapers from the edge of the central region 83 to the crown and sole edges of the face component 40. FIG. 13A illustrates a cross-sectional view of the thickness variation. In a preferred embodiment, the central region 83 has a thickness that ranges from 0.080 inch to 0.125 inch, and most preferably approximately 0.100 inch. The central region 83 has preferably extends 0.75 inch across the center of the striking plate 50 in a crown to sole direction. The periphery region 85 preferably has a thickness that tapers from the edge 83*a* of the central region 83 to a final thickness of approximately 0.040 inch at the edge of the face component 40.

Other such variable thickness patterns are disclosed in Kosmatka, U.S. Pat. No. 5,830,084 for a Contoured Golf Club Face, Galloway, et al., U.S. Pat. No. 6,354,962 for a Golf Club Head With A Face Composed Of A Forged Material, Galloway, U.S. Pat. No. 6,368,234, for a Golf Club Striking Plate Having Elliptical Regions Of Thickness, and Evans, et al., U.S. Pat. No. 6,398,666 for a Golf Club Striking Plate With Variable Thickness, each of which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body having a crown, a sole, a ribbon, a heel front wall and a toe front wall, the crown having a thickness of 0.030 inch to 0.050 inch, the sole having a thickness of 0.030 inch to 0.050 inch, the body composed of a cast titanium alloy material, the body having an opening in a portion of the front wall, a portion of the crown and a portion of the sole; and a U-shaped face component positioned within the opening and welded to the body, the U-shaped face component having a striking plate, a crown extension substantially perpendicular to the striking plate, and a sole extension substantially perpendicular to the striking plate, the striking plate welded to the heel front wall and the toe front wall, the crown extension welded to the crown of the body, and the sole extension welded to the sole of the body, the face component having a uniform thickness in the range of 0.080 inch to 0.120 inch, the face component composed of a formed titanium alloy material;

wherein the golf club head has a volume ranging from 350 cubic centimeters to 420 cubic centimeters and a mass ranging from 185 grams to 215 grams, and the golf club head has a coefficient of restitution ranging from 0.80 to 0.87.

2. The golf club head according to claim 1 wherein the striking plate of the U-shaped face component has a width ranging from 2.0 inches to 4.0 inches.

3. The golf club head according to claim 1 wherein the crown extension of the U-shaped face component extends from 0.250 inch to 2.5 inches from the striking plate.

4. The golf club head according to claim 1 wherein the crown extension of the U-shaped face component has an arc shape.

5. The golf club head according to claim 1 wherein the sole extension of the U-shaped face component extends from 0.250 inch to 2.5 inches from the striking plate.

6. The golf club head according to claim 1 wherein the sole extension of the U-shaped face component has an arc shape.

7. The golf club head according to claim 1 wherein the sole extension of the U-shaped face component has a triangular shape.

8. The golf club head according to claim 1 wherein the crown extension of the U-shaped face component has a triangular shape.

9. The golf club head according to claim 1 wherein the striking plate of the U-shaped face component is 50% to 80% of the face area of the golf club head.

10. A golf club head comprising:

a body having a crown, a sole, a ribbon and a front wall, the front wall including a heel front wall and a toe front wall, the body having an opening in the front wall separating the heel front wall from the toe front wall and extending into the crown and the sole, the body composed of a metal material and having a hollow interior; and a face component positioned within the opening and attached to the body, the face component having a striking plate, a crown return extending from the striking plate, and a sole return extending from the striking plate, the face component composed of a metal material;

wherein the golf club head has a volume ranging from 300 cubic centimeters to 500 cubic centimeters, and the golf club head has a coefficient of restitution ranging from 0.80 to 0.88.

11. The golf club head according to claim 10 wherein the body is composed of a cast titanium alloy material and the face component is composed of a formed titanium alloy material.

12. The golf club head according to claim 10 wherein the striking plate of the face component has a width ranging from 2.0 inches to 4.0 inches.

13. The golf club head according to claim 10 wherein the crown return of the face component extends from 0.250 inch to 2.5 inches from the striking plate.

14. The golf club head according to claim 10 wherein the crown return of the face component has an arc shape.

15. The golf club head according to claim 10 wherein the sole return of the face component extends from 0.250 inch to 2.5 inches from the striking plate.

16. The golf club head according to claim 10 wherein the sole return of the face component has an arc shape.

17. The golf club head according to claim 10 wherein the sole return of the face component has a triangular shape.

18. The golf club head according to claim 10 wherein the crown return of the face component has a triangular shape.

19. The golf club head according to claim 10 wherein the striking plate of the face component is 50% to 80% of the face area of the golf club head.

20. A golf club head comprising:

a body having a crown, a sole, a ribbon and a front wall, the front wall including a heel front wall and a toe front wall, the body having an opening in the front wall separating the heel front wall from the toe front wall and extending into the crown and the sole, the body composed of a titanium alloy material and having a hollow interior; and a face component positioned within the opening and attached to the body, the face component having a striking plate, a crown return extending from the striking plate, and a sole return extending from the striking plate, the face component composed of a formed titanium alloy material;

wherein the golf club head has a volume ranging from 300 cubic centimeters to 500 cubic centimeters, the golf club head has a coefficient of restitution ranging form 0.80 to 0.88, and a moment of inertia, Izz, about the Z axis of the center of gravity of the golf club head ranging from 2700 g-cm$^2$ to 4000 g-cm$^2$.

21. The golf club head according to claim 20 wherein a face of the golf club head has an aspect ratio of at least 0.565.

22. The golf club head according to claim 20 wherein the golf club head has a moment of inertia, Iyy, about the Y axis of the center of gravity of the golf club head ranging from 1500 g-cm$^2$ to 3500 g-cm$^2$.

23. A golf club head comprising:

a body having a crown, a sole, a ribbon and a front wall, the front wall including a heel front wall and a toe front wall, the body having an opening in the front wall separating the heel front wall from the toe front wall and extending into the crown and the sole, the body composed of a metal material and having a hollow interior; and a face component positioned within the opening and attached to the body, the face component having a striking plate, a crown return extending from the striking plate, and a sole return extending from the striking plate, the face component composed of a metal material, wherein the face component has a central region of a first thickness and a periphery region having a tapering thickness from an edge of the central region to an edge of the face component.

24. The golf club head according to claim 23 wherein the central region has a thickness ranging from 0.125 inch to 0.080 inch.

* * * * *